US005390597A

United States Patent [19]

Hashimoto et al.

[11] Patent Number: 5,390,597

[45] Date of Patent: Feb. 21, 1995

[54] OFFSET PRESS

[75] Inventors: Takao Hashimoto; Hiroshi Sato, both of Iwate; Mitsuo Nagaoka, Kanagawa; Koichi Kamoi, Saitama; Mamoru Mizuno, Setagaya, all of Japan

[73] Assignee: Gradco (Japan) Ltd., Tokyo, Japan

[21] Appl. No.: 287,422

[22] Filed: Aug. 9, 1994

Related U.S. Application Data

[63] Continuation of Ser. No. 971,612, Nov. 5, 1992, abandoned.

[30] Foreign Application Priority Data

Nov. 8, 1991 [JP] Japan ..... 3-319602
Oct. 21, 1992 [JP] Japan ..... 4-305838

[51] Int. Cl.[6] ..... B41F 7/02; B41F 7/26

[52] U.S. Cl. ..... 101/142; 101/DIG. 48; 101/425

[58] Field of Search ..... 101/212, 217, 218, 216, 101/178, 177, 130, 136, 137, 141, 142, DIG. 48, 143, 144, 425, 423, 424

[56] References Cited

U.S. PATENT DOCUMENTS 2,788,738 4/1957 Wood ..... 101/212 X
3,577,916 5/1971 Tonkin ..... 101/148
3,735,702 5/1973 Kossak ..... 101/425
5,142,978 9/1992 Borel ..... 101/352 X

FOREIGN PATENT DOCUMENTS 435410 7/1991 European Pat. Off. ..... 101/415.1

*Primary Examiner*—J. Reed Fisher

[57] ABSTRACT

A compact, low-height offset press of simple construction is easy to use, needs no after-use maintenance such as cleaning the ink roller and is designed for fully automatic operation. Plate support 1 and blanket support 10 consist of endless belts. Etching unit 60, dampening unit 70 and inking unit 80 are placed along the periphery of the plate support. An unetched plate is supplied from the plate supply unit and etched automatically for printing. When the press is not in use, anti-drying tank 95 moves up, enclosing the roller(s) in liquid, to prevent any ink on the roller surfaces from drying.

6 Claims, 5 Drawing Sheets

OFFSET PRESS

This application is a continuation of United States application Ser. No. 07/971,612, filed Nov. 5, 1992, now abandoned.

BACKGROUND OF THE INVENTION

This invention pertains to printing equipment, particularly easy-to-use compact printing equipment.

Previously, offset presses have generally had plate cylinders, blanket cylinders and impression cylinders. In the case of multiple color printing, units consisting of these three cylinders are generally used in tandem, one three-cylinder unit for each color. The printed material is passed through one unit to the next until all the colors have been printed. The aforementioned plate cylinder consists of a clamp that affixes the plate to the cylinder's surface. The blanket cylinder is a cylinder around which the blanket is wrapped and, like the aforementioned plate drum, has a depression to accommodate the clamp in its outer periphery. Normally the aforementioned plate cylinder and blanket cylinder have an effective circumference greater than the length of one plate, and transfer and print one plate per revolution. There are, however, also some plate cylinders and blanket cylinders with effective circumferences the length of two plates. This is achieved by doubling the diameters of the plate and blanket cylinders and allows two types of plates to be printed per revolution.

Previously there have been offset presses of all sizes, from large offset sheet-feed rotary presses and web-fed offset rotary presses to small offset presses that handle B4 and A4 sheets. However, the fundamental necessity that offset presses have effective plate cylinder and blanket cylinder circumferences at least equal to the length of the plates has imposed a limit on the degree to which they can be miniaturized. Even compact B4 size offset presses have cylinders 20 cm or more in height. Another difficulty is that because both the plate cylinder and blanket cylinder are cylindrical, the dampening unit, inking unit, cleaning unit and drying unit must all be concentrated into a small area. This entails complex mechanical design and usually increases the difficulty of operation. In particular, in the case of small offset presses, because of the need to place the dampening and inking units next to the plate cylinder, concentrated into a small area around the plate cylinder, it is quite difficult to include the etching unit next the plate cylinder as well. Accordingly, with small presses the etching unit is usually a separate device.

Offset presses have had the advantage of relatively greater speed, simplicity and economy—and this accounts for their popularity—but they have also suffered from some disadvantages, such as the fine adjustment of dampening water and ink and rapid exchanges of the three cylinders, which necessitate complex mechanisms and a high level of operator skill. The combined large size and high level of operator skill. The combined large size and high prices of presses have tended to limit their use to firms that specialize in printing. Compact, inexpensive and easy-to-use presses suitable for the needs of general office printing (i.e., diverse, small-lot printing) have yet to be introduced.

In addition, printing ink dries quickly and thus can harden on the surface of the ink roller(s) if left uncleaned after printing, so detachment and cleaning of the ink roller unit is necessary after each print run. This dirty work before and after printing makes the printer difficult to use. Easy-to-use offset printer that can handle everything, including this particular operation, have yet to be introduced and are in demand.

SUMMARY OF THE INVENTION

This invention seeks to solve the aforementioned problems typical of conventional offset presses. The technical challenge is to provide presses with low profiles, simpler mechanisms and smaller size that can handle all ordinary processes automatically, can be produced more cheaply and are easier to operate.

This invention addresses the aforementioned problems using a configuration in which the plate support consists of an endless belt and the etching unit and the inking unit are placed along the periphery of the plate support in contact with the plate support. It is desirable that the offset press also have a blanket support consisting of an endless belt.

The plate supply unit, which automatically supplies the plate, and the plate output unit, which ejects the plate from the plate support, allow automatic supply and output of the master plate and continuous printing of many sheets.

In addition, the inking unit, which consists of an ink roller unit and a tank that contains an anti-drying liquid and is movable in the direction of the ink roller unit so unused ink rollers are dipped into the liquid, preventing any ink left on the ink roller(s) from drying. To ensure that the tank and ink roller unit meet at the right place, either may be removed.

By making the plate support and/or blanket support an endless belt, the effective length can be increased without increasing the diameter of the cylinders. Thus the use of endless belts allows a tremendous reduction in the height and overall compactness of the press. Since the effective length of the plate support or blanket support can be extended, several plates can be attached to a single plate support at one time and multiple plates can be printed in a single printing cycle.

Further, because the effective length of the plate support can be extended, the inking unit, dampening unit and other items need not be concentrated next to the cylinders, but instead may be placed anywhere. These units can thus be placed to advantage in terms of ease of operation, ease of manufacture, etc. The etching unit can also be easily built in. The result is a compact press with a built-in etching unit.

Because the plate support and blanket support are deflectable belts, partial deflection of the belts bring the two into contact, without moving the entire support, to transfer the image and print. Compared with conventional models that require rapid movement to attach and detach all cylinders, this construction places less load on the machine, simplifies the structure and cuts noise.

When not in use, the inking unit dips into the liquid, which prevents the ink from drying. This spares troublesome dirty work, such as cleaning the ink roller(s) after printing, and gets the press ready for another printing operation after a certain period of time. The result is a fully automatic offset press that requires no manual operations before or after printing.

BRIEF DESCRIPTION OF THE DRAWING

Diagram 1 is a side elevation with the side cover removed, showing an offset press in accordance with the invention;

Diagram 2 is a side elevation of the other side of the offset press from Diagram 1;

Figure 1:
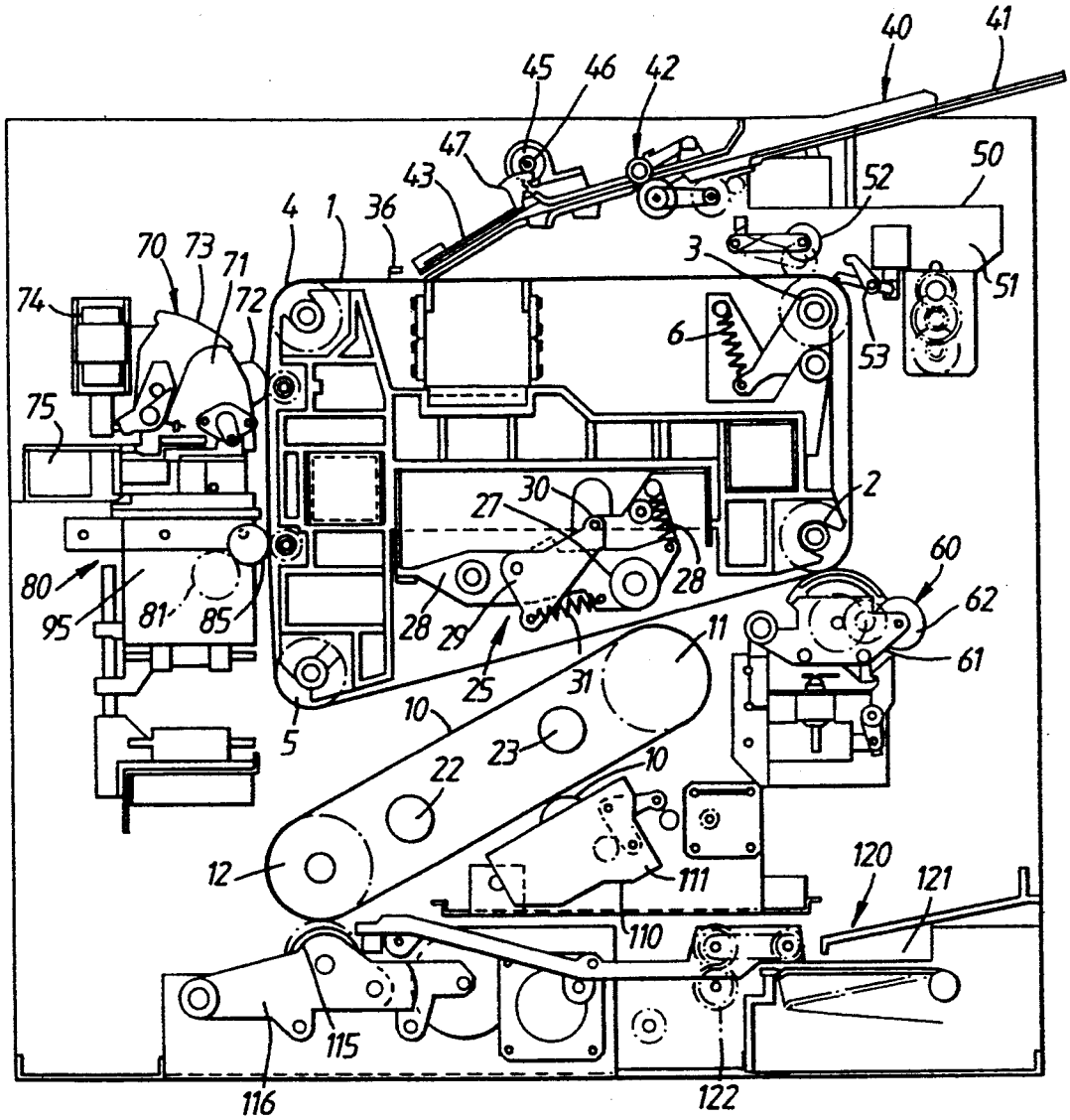
Figure 2:
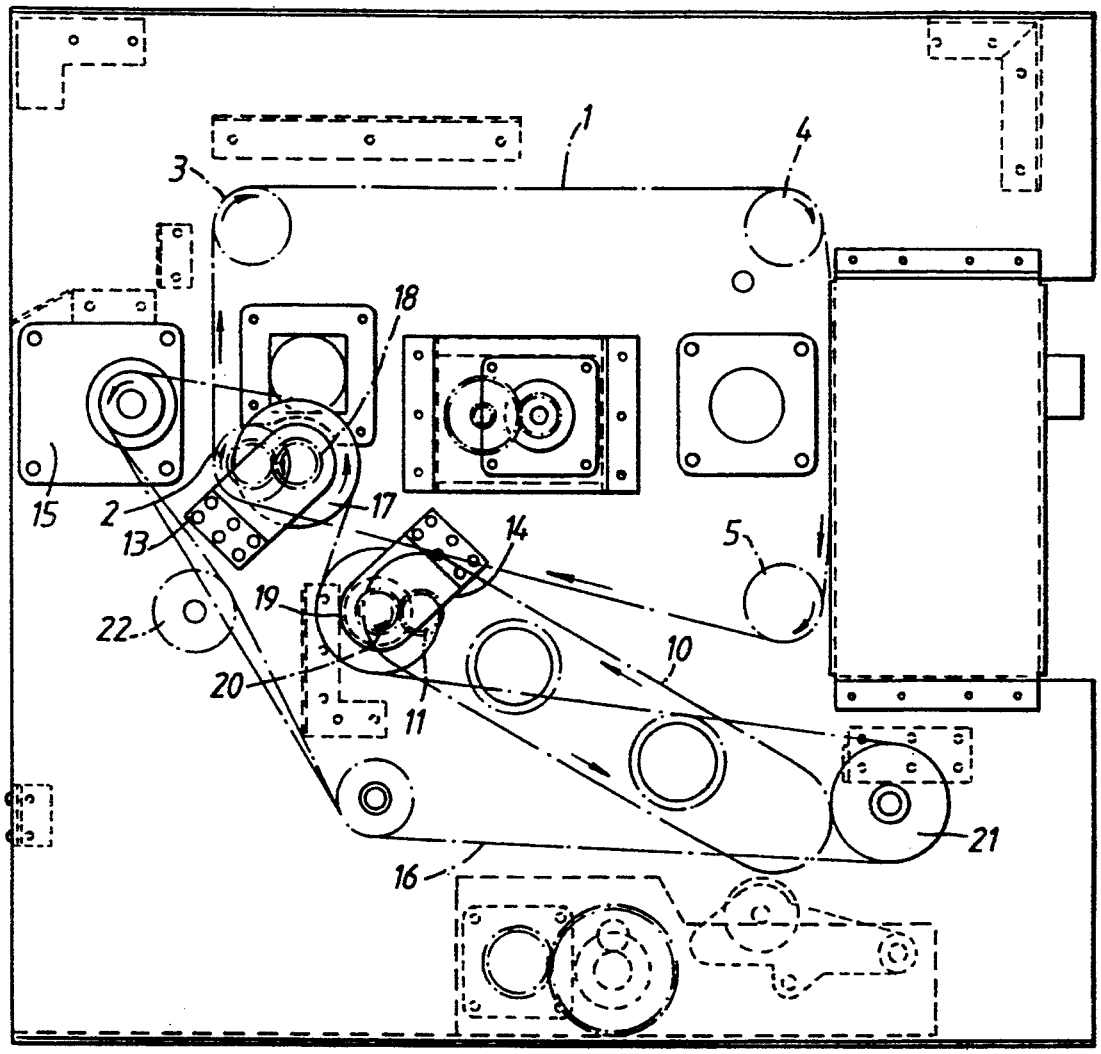
Figure 3:
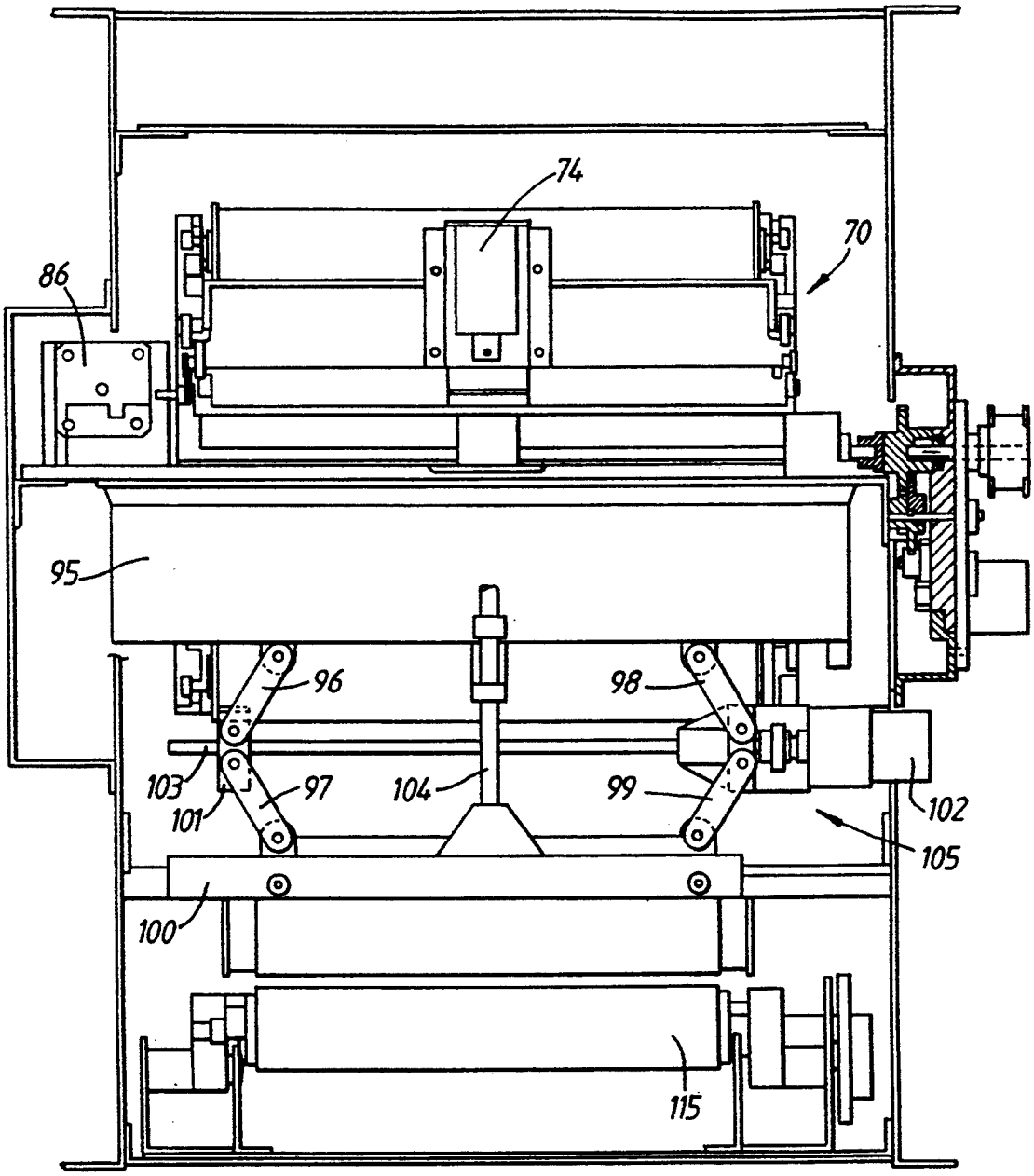
Figure 4:
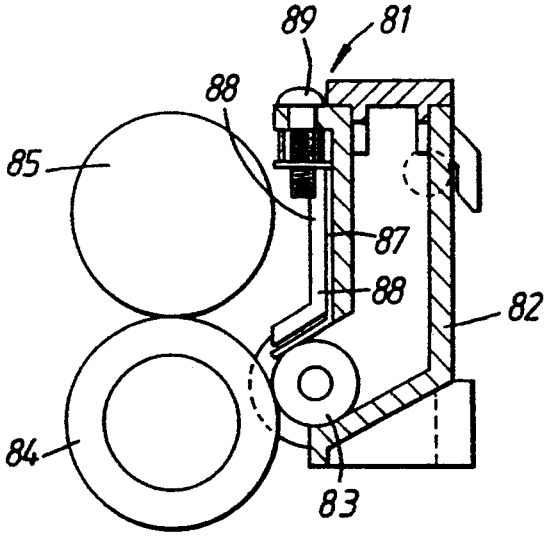
Figure 5:
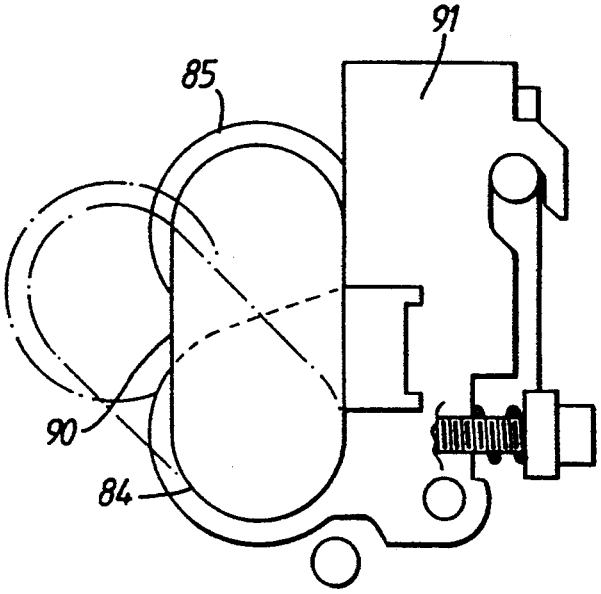
Figure 6:
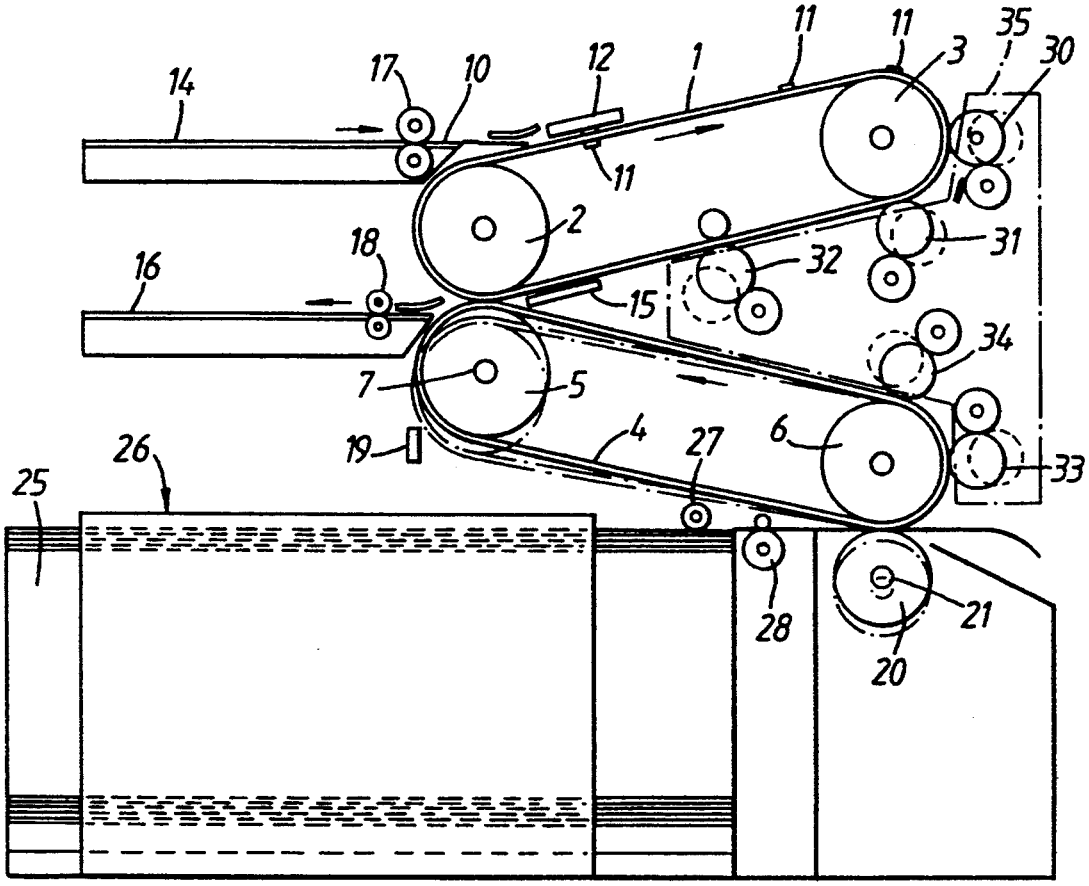

Diagram 3 is an end elevation as viewed from the left end of Diagram 1 with the cover removed;

Diagram 4 is a fragmentary detail view showing the inking unit;

Diagram 5. is another fragmentary detail view showing the inking unit; and

Diagram 6 shows another version of the offset press.

DESCRIPTION OF THE PREFERRED EMBODIMENT

The following is an example of the implementation of this invention in an offset press, explained based on the enclosed diagram 1–5. Diagram 1 shows the internal mechanism and part layout of the offset press in the implementation example as seen from the front. This example shows a press in which traditional plate and blanket cylinders are both replaced with endless belts. Plate support 1 uses an endless belt made of a compound material with plastic as the main ingredient. The endless belt is hung on pulleys 2 and guide pulleys 3, 4 and 5. Guide pulley 3 places a certain amount of tension on plate support 1. It is supported by floating axle 7, which is pressed by spring 6 in the direction of tension. Like plate support 1, blanket support 10, on which the blanket is placed, uses an endless belt made of a compound material with plastic as the main ingredient. It is hung on drive pulley 1 and guide pulley 12. The blanket is layered endlessly around the outer periphery of blanket support 10. It becomes part of the blanket support. However, it would also be entirely possible to use a conventional sheet-type blanket and a freely attaching-/detaching gripper on the outer periphery of the blanket support. Blanket support 10, along with its drive and guide pulleys, is a module that can be attached to or detached from guide rods 22 and 23 of the body. Although not shown in the diagram, plate support 1 and blanket support 10 have metal tags or some other appropriate position indicators attached in the appropriate position. On the outside attachment position of that rotation, there is a noncontact switch, photoelectric sensor or some other position detection method that detects said position indicator. This allows detection of the plate and blanket positions.

As shown in the drive mechanism in Diagram 2, plate support 1 and blanket support 10 are forcibly rotated in synchronization by main motor 15. In other words, drive gears 13 and 14 are affixed to the end of drive roller 2 of the plate support, and to the end of drive roller 11 of blanket support 10. These gears are engaged with two other gears; gear 18, affixed to the axle of plate support drive pulley 17 (the pulley that moves along with timing belt 16, driven by the main motor) and gear 20, affixed to the axle of blanket support drive pulley 19. Motor 115 also drives and rotates the rollers of the ink roller unit, which will be discussed later. Timing belt 16 also transmits power to pulley 21, which drives the ink roller. Pulley 22 in Diagram 2 adjusts the tension of timing belt 16. It is supported by a floating arm, which is pressed in the direction of tension on the timing belt.

Plate support 1 and blanket support 10 are normally not in contact. Transfer roller unit 25 is there to make the two rotate and come into contact only when an image is transferred from the plate held by the plate support to the surface of the blanket held by the blanket support. Transfer roller unit 25 has floating lever 26, which is borne in a way that allows it to oscillate, and transfer roller 27 is affixed to floating lever 26. Floating lever 26 is normally held by spring 28 in a position where the transfer roller does not contact the back of the blanket. When an image is transferred, lever 26 is pressed by a cam (not shown in the diagram) and moves clockwise in Diagram 1. This makes transfer roller 27 press plate support 1 from the back. Then transfer roller 27 and plate support drive roller 11 together bring the plate support and blanket support into contact so the image is transferred from the plate support to the blanket belt.

As a more desirable configuration, this implementation example has floating lever 29, as well as floating lever 26, to attach a cam follower, and cam follower 30 is attached to floating lever 29. Floating lever 29 is normally pressed in counterclockwise, as in Diagram 1, by spring 31 between it and floating lever 26. When cam follower 30 is pushed down by a cam (not shown in the diagram), it indirectly presses floating lever 26 via floating lever 29. This prevents excessive pressure on the transfer roller and maintains proper transfer pressure at all times.

The plate support has gripper 36 to hold the plate. The gripper is opened or closed by an actuating cam positioned where the plate is supplied, grips the edge of the plate, which is supplied by plate supply unit 40, between itself and plate support 1, and holds the plate on the plate support. When the plate is to be ejected, the aforementioned cam opens gripper 36 so the plate can be released and ejected to plate output unit 50. Plate supply unit 40 consists of plate supply tray 41, which can hold multiple layers of plates; a group of motor-driven supply rollers (42), which separates the masters stacked on the tray and feeds them one by one to the plate support; and printing plate guide plate 43, which is positioned among supply rollers 42 near the outside.

On the edge of the base of printing plate guide plate 43, segment gear 44 engages with output gear 46 of device 45, which drives the rotary solenoid and other parts. Driven by device 45, the edge of the printing plate guide plate oscillates about 15 degrees between the plate supply position and withdrawal position. This moves down the edge of the printing plate guide plate, closer to the plate support, to allow smooth action when the plate is supplied, and keeps the edge high so that it does not interfere with the rotation of the plate support.

Plate output device 50 consists of plate output tray 51; plate output roller 52, which is detachable from the plate support, separates the plate from the plate support and feeds it to plate output tray 51; and floating plate output guide 53, which guides the plate to the plate output tray.

Etching unit 60, dampening unit 70 and inking unit 80 are positioned along the periphery of the plate support so that etching fluid, water and ink can be applied automatically at appropriate times to the plate, held by the plate support.

Etching unit 60 includes etching roller 62, which contacts the etching fluid in etching fluid tank 61 directly or via a transfer roller. Etching roller 62, rotated by a motor not shown in the diagram, normally does not contact the plate support, but receiving etching signals, it moves to the contact point to apply etching fluid to the plate, held by and moving in concert with the plate support.

Dampening unit 70 consists of tank 71, water supply roller 72, which applies water to the plate held by the plate support, and one or more transfer rollers (not shown in the diagram) to transfer water from tank 71 to the water supply roller. Normally, the water supply roller is not in contact with the plate support, and tank 71 is covered by cover 73, which can be opened or closed by cylinder 74. When dampening signals are sent, the transfer roller(s) and water supply roller are driven and rotate, water is transferred to the surface of the water supply roller, cylinder 75 moves the water supply roller and the tank together until they contact the plate, held by and moving in concert with the, plate support, and apply water to it.

Inking unit 80 consists of ink roller unit 81 and tank 95 which contains an anti-drying liquid and is movable toward the ink roller unit so that used ink rollers dip into the liquid to prevent the ink from drying.

As shown in Diagram 4, ink roller unit 81 consists of ink pullout roller 83, transfer roller 84 and application roller 85, all located adjacent to the lower mouth of the ink container. Application roller 85 rotates on transfer roller 84 until it reaches the inking position on the plate, marked by a line in Diagram 5. Power from rollers 83, 84 and 85 is transferred to inking unit drive pulley 21, which is driven by motor 15 via aa transfer mechanism not shown in the diagram, and all rotate in synchronization. In Diagram 4, No. 87 is the ink adjustment plate and 88 the leaf spring that presses the ink adjustment plate. By adjusting screw 89, ink adjustment plate 87 adjusts the distance between its edge and the ink pullout roller, and in so doing controls the amount of ink to be pulled out. No. 90 in Diagram 5 is a side plate integrated with oscillation plate 91 that supports the aforementioned ink roller. It rotates the application roller it supports to the place to be inked by oscillating oscillation plate 91 with appropriate methods.

As shown clearly in Diagrams 1 and 3, anti-drying liquid tank 95 is supported by base 100 via the lifter. The lifter consists of axles 96–99, which constitute a parallel linkage mechanism. Joint 101, which joins axles 96 and 97 is screwed into screw rod 103, which is rotated by motor 102. Rotation of the screw rod moves joint 101 to the right or left (see Diagram 3) and moves anti-drying liquid tank 95 up or down via the parallel linkage mechanism. No. 104 is a guide rod attached to base 100. The anti-drying liquid may be anything that does not react chemically with the ink and prevents the ink from contacting air. Specifically, water is recommended.

Cleaning unit 110 is positioned at the periphery of the blanket support. Like those used in conventional offset presses, cleaning unit 110 consists of tank 111, which contains a solvent, and cleaning roller unit 102. The cleaning roller is normally away from the blanket belt, and it comes into contact with the belt when the cleaning roller starts oscillating automatically after receiving the "start cleaning" signal.

No. 115 in Diagram 1 is the impression cylinder. This cylinder is supported by floating axle 116 and placed in a position where it can move in or out of contact with the blanket belt according to the oscillation mechanism of the cam system and other parts, and can automatically move to the contact position in printing. No. 120 is the paper supply unit, which pulls paper from paper supply tray 121 one sheet at a time using paper supply rollers 122.

Next is an explanation of how the offset press of this implementation example operates. The plate could be a presensitized plate or another one of various established kinds of plates, like the PS plate. In this implementation example, however, there is a built-in etching unit, so unetched paper plates may be used. Until printing begins, blanket support 10 is in the position shown in the Diagram 1, so it does not come into contact with plate support 1. In this condition, the number of prints and various printing conditions may be set at the control panel, not shown in the diagram. When the necessary information has been input and the printer actuated, the plate placed on the plate supply table 41 is automatically fed to plate support 1 according to the appropriate timing. The gripper actuation cam actuates gripper 36 so that it grips the plate and begins turning at the rated speed. First the etching roller of the etching unit contacts the plate and uses etching fluid to remove the image film and expose the parent layer. After etching is finished, the etching roller automatically withdraws and then water supply roller 72 from the dampening unit is brought into contact with the plate surface. This dampens the surface of the plate so the non-image areas becomes wet with water, and the water supply roller withdraws when the dampening operation is finished.

Next the lifter moves tank 95 of the inking unit, which contains anti-drying liquid, down to expose the ink rollers of unit 81, which have been in the liquid in the tank. In this condition, ink rollers 85 tilts, contacts the plate on the plate support and transfers ink to the image areas of the plate.

When the plate support has rotated and the ink is evenly distributed and preparation for printing is complete, transfers roller unit 25 is actuated at the appropriate time and presses plate support 1. The blanket mounted on blanket support 10 rotates while pressed against the plate mounted on the plate support, and the image is transferred to the blanket. Then, according to the blanket position and the timing, paper is fed from paper supply tray 121 by paper supply rollers 122, and the paper is printed between the impression cylinder and blanket support. The printed paper is output to the output paper table, which is not shown in the diagram.

When this occurs, the position indicators on plate support 1 and blanket support 10 are detected by the sensor, which marks the positions of the plate and blanket, and thus plate supply unit 40, etching unit 60, dampening unit 70, inking unit 80, transfer roller unit 25, cleaning unit 110, paper supply unit 120, impression cylinder 115 and other components are actuated automatically accordingly at the appropriate times.

When the specified number of prints have been made, the gripper cam actuates to open gripper 36 and release the plate, and the plate support begins a reverse rotation. In synchronization with this, plate output roller 52 and plate output guide 53, both of which are parts of plate output unit 50, move into their operation positions to eject the plate from the plate support to plate output tray 51. At this point a second plate may be fed automatically into the printer and the series of operations repeated. Meanwhile, the blanket cleaning unit supported by the blanket support actuates to wash the blanket clean. Then it is dried by the drying unit and readied for transfer of the next image.

When printing is complete, lifter 105 is actuated and tank 95, which contains the anti-drying liquid, moves up to enclose ink roller unit 81 in liquid. This prevents the ink on the roller from drying and hardening and keeps the printer always ready to print because the ink is not in contact with air.

The above is a good example of how this invention can be implemented. However, the possibilities for implementation are by no means limited to this example. A wide range of design variations are possible.

For example, in the implementation example above, both the plate support and the blanket support are made of endless belts, but even if both of the supports are not made of endless belts, either one could use an endless belt while the other uses a conventional cylinder. This would still allow a significantly more compact press than conventional presses. Also, it is not essential than the belt be a single broad band. It could conceivably consist of two fine chains at each edge of the support, connected by flexible support plates in between. It is possible that such flexible support plates would be sufficient to hold the plate and/or blanket.

Accordingly, the conceptual scope of endless belt described in the patent claim is not necessarily limited to a simple broad endless belt; rather, it covers any use of "endless" fine chains, belts, etc. hung between two pulleys to achieve a comparable transportation effect.

Also, variations on attachment of the plate support and blanket support and the aforementioned gripper are also possible. A vacuum or any other form of attachment could be used. Furthermore, the plate support and blanket support positions need not be exactly as shown in the implementation example; depending on need, a wide range of positions are possible. It hardly needs pointing out that the inking unit(s) and other units may similarly be positioned elsewhere if desired. This invention may also be applied to waterless offset printing, in which case the dampening unit of the implementation example may be eliminated.

An offset printing press of this invention, configured as outlined above, obtains several distinct effects.

Further, because the inking unit, dampening unit and other items need not be concentrated next to the cylinders, but instead may be placed anywhere, these units can be placed to greater advantage in terms of ease of operation, ease of manufacture, etc. The etching unit can also be easily built in.

Again the effective circumference length of the plate support and blanket support can be set at will, so several plates can be attached to a single plate support at the same time. This means multiple colors or more than a single sheet can be printed in a single printing cycle.

Further, in place of the plate cylinder and blanket cylinder previously obtained through matching, relatively inexpensive endless belts can be used, so the cost of presses using endless belts can be less than that of comparable conventional presses.

Because the plate support and blanket support are deflectable belts, partial deflection of the belts bring the two into contact, without moving the entire support, to transfer the image and print. Compared with conventional models that require rapid movement to attach and detach all cylinders, this construction places less load on the machine, simplifies the structure, cuts noise, and allows easier adjustment of transfer pressure.

When not in use, the inking unit dips into the liquid, which prevents the ink from drying. This spares troublesome dirty work before and after printing, such as cleaning the ink roller(s), allows continuous printing operations and makes the machine easier to use.

The following is an example of the implementation of this invention in an offset press, explained based on the enclosed diagram 6. This offset press implementation example shows the case of a press in which traditional plate and blanket cylinders are both replaced with endless belts. Plate support 1 uses an endless belt made of a compound material with plastic as the main ingredient. The endless belt is hung on pulleys 2 and 3. Like plate support 1, blanket support 4, on which the blanket is placed, uses an endless belt made of a compound material with plastic as the main ingredient. it is hung on pulleys 5 and 6. Pulley 5 rotates on axle 7 mounted in a movable frame actuated by a cylinder or other device. By raising and lowering the said movable frame, the outer periphery of the blanket support pulley is able to freely engage and disengage the aforementioned plate support at the outer periphery of pulley 2. Rotational contact between the two transfers the image of the plate mounted on the plate support to the surface of the blanket supported by the blanket support. Plate support 1 and blanket support 4 are forcibly rotated in synchronization by the introduction of a common drive method not shown in the diagram.

Plate support 1 includes gripper 11 used to affix plate 10. As shown in the diagram, through contact with No. 1 gripper actuation cam 12 provided in the plate supply position, the gripper is actuated and grips the plate supplied from plate supply tray 14. Also, No. 2 gripper actuation cam 15 provided in the plate output position opens the gripper outputs the plate to plate output tray 16. Furthermore, 17 is the plate supply roller attached to the plate supply tray, and 18 is the plate output roller attached to the plate output tray.

In this implementation example, the blanket uses an endless belt. The said blanket is endlessly layered around the outer periphery of blanket support 4. It becomes part of the blanket support. Although not shown in the diagram, the blanket support has metal or some other appropriate position indicator attached in the appropriate position. On the outside attachment position of that rotation there is a noncontact switch, photoelectric sensor or some other position detection method 19 that detects the said position indicator. This enables detection of the blanket position. However, it would also be entirely possible to use a conventional sheet-type blanket and a freely attaching/detaching gripper provided on the outer periphery of the blanket support.

Impression cylinder 20 is supported by axle 21 which is mounted in a movable bracket so that the outer periphery of pulley 6 on the side opposite that contacting the plate support rotates while pressed against the outer periphery of the blanket support. The interaxle distance between pulley 6 and impression cylinder 20 can be freely adjusted, allowing fine adjustment of the printing pressure as well as attachment and detachment. In the implementation example shown, paper supply tray 26, which holds printing paper 25, is underneath the blanket support. The printing paper on the tray at its upper end is pulled off one sheet at a time and fed to the paper supply roller unit by separation roller 27.

As shown in the diagram, the aforementioned plate support 1 and blanket support 4 are brought together to transfer the image by pulleys 2 and 5. Pulleys 3 and 6 are positioned at an angle to each other so a space with a triangular cross section is produced among them. The inking unit(s) and other devices can be placed in this space, enabling a compact configuration. On the outer periphery of plate support 1 are the freely attachable/-detachable etching unit 30, dampening unit 31 and inking unit 32, respectively. Also, on the outer periphery of blanket support 4, the cleaning unit 33 and drying unit 44 are movable, positioned appropriately close to the blanket support to enable attachment and detachment.

In the implementation example, these devices are integrated in a single cassette mounted on frame unit 35 to let them all be attached and detached simultaneously for easier operation. It would, of course, be entirely possible to install them to allow free attachment and detachment of each of them separately.

Next, is an explanation of how the offset press of this implementation example operates. Plate 10 could be a presensitized plate or another one of various established kinds of plates. In this implementation example, however, there is a built-in etching unit, so non-etched master paper can be used. Until printing begins blanket support 4 is in the position shown by dotted lines sin the diagram, so it does not come into contact with plate support 1. In this condition, the number of prints and various printing conditions can be set on a control panel not shown in the diagram. When the necessary information has been input and the printer actuated, the master paper placed on the plate supply table is automatically fed to plate support 1 according to the appropriate timing. No. 1 gripper actuation cam 12 actuates gripper 11 so it grips the master paper and begins turning at the rated speed. First the etching roller of the etching unit contacts the master paper and uses etching fluid to remove the image film and expose the oil comfortable layer. After etching is finished, the etching roller automatically withdraws and then water from the dampening unit is brought into contact with the master surface. This dampens the surface of the master paper so the non-image areas becomes wet with water. Next the water supply roller withdraws and the inking unit's ink roller is brought into contact with the master paper to attach ink to the master paper image areas.

When the plate support has rotated and the ink been evenly distributed, preparations for printing are complete and pulley 5 automatically begins rotating. The blanket mounted on the blanket support rotates while being presses against the master mounted on the plate support and thus the image is transferred to the blanket. When this occurs, blanket position sensor 19 detects the blanket reference position and pulley 5 rotates according to the specified timing so the blanket support contacts the plate support so the plate and blanket are properly positioned. Then, according to the blanket position and the timing, paper is fed from the paper supply tray by the paper supply unit and the paper is printed between the impression cylinder and blanket support. The printed paper is output to the output paper table, which is not shown in the diagram. Also, when the gripper protruding from the surface of the plate support passes the blanket support contact section, pulley 5 rotates so the blanket support is able to avoid the protruding gripper.

When the specified number of prints have been made, the No. 2 gripper actuation cam actuates to open gripper 11 and release the master paper, which is output from the plate support to plate output tray 16. Then pulley 5 rotates, the distance between pulleys 5 and 2 is broadened and the printer is ready for the next stage of printing. At this point, the second master is automatically fed into the printer and the aforementioned series of operations repeated. Meanwhile, the blanket cleaning unit supported by the blanket support actuates to wash the blanket clean. Then it is dried by the drying unit and readied for transfer of the next image.

The above is a good example of how this invention can be implemented. However, the possibilities for implementation are by no means limited to this example only. A wide range of design variations are possible. For example, in the implementation example above, both the plate support and the blanket support are made of endless belts, but even if both of the supports are not made of endless belts, either one could use an endless belt while the other uses a conventional cylinder. This would still enable a press significantly more compact than conventional presses. Also, it is not essential than the belt be a single broad band. It could conceivably consist of two fine chains at each edge of the support, connected by flexible support plates in between. It is possible that such flexible support plates would be sufficient to hold the plate and/or blanket. Accordingly, the conceptual scope of endless belt described in the patent claim is not necessarily limited to a simple broad endless belt; rather, it covers any use of "endless" fine chains, belts, etc. hung between two pulleys to achieve a comparable transportation effect.

Also, variations on attachment of the plate support and blanket support and the aforementioned gripper are also possible. A vacuum or any other form of attachment could be used. Furthermore, the plate support and blanket support do not have to be exactly as shown in the implementation example; depending on need, a wide range of positions are possible. Furthermore, it hardly needs pointing out that the inking unit(s) and other units may similarly be positioned elsewhere if desired. Particularly in the case of this press, because it uses endless belts for both the plate support and the blanket support, the dampening unit, inking unit and other units do not need to be concentrated in a narrow area next to the cylinders as was necessary in previous offset presses. Instead, they can be spread out anywhere over the flat area of the belt. The etching unit can also be neatly accommodated inside. Finally, this invention can also be applied to waterless offset printing, in which case the dampening unit of the implementation example can be eliminated.

The offset printing press of this invention, configured as outlined above, obtains several distinct effects. By making the plate support and blanket support of endless belts, the cylinders can be made much smaller than previously and still obtain the necessary effective circumference length. This enables a tremendous reduction in the height of the press, and thus enables more compact equipment. Furthermore, because the inking unit, dampening unit and other items do not need to be concentrated next to the cylinders, but instead can be placed anywhere, these units can be placed so as to accrue advantages in terms of ease of operation, ease of manufacture, etc. The etching unit can also be easily built in. Again, the effective circumference length of the plate support and blanket support can be set at will, so several master papers can be attached to a single plate support at one time. This means multiple colors can be printed in a single printing cycle. Furthermore, in place of the plate cylinder and blanket cylinder previously obtained through machining, relatively inexpensive endless belts can be used, so the cost of presses using endless belts can be less than comparable conventional presses.

We claim:

1. In offset printing equipment comprising a plate support, a blanket support, an etching unit, a dampening unit, and an inking unit, the improvement wherein: said plate support and said blanket support each includes an endless belt disposed in vertically spaced relation one above the other and extending horizontally, said endless belt of said plate support having means for gripping a plurality of plates thereon in succession, plate feeding means for supplying plates to said gripping means on said belt of said plate support in succession, plate output means for ejecting successive plates from said plate support; the etching unit, the dampening unit and the inking unit are positioned along the periphery of said endless belt of the plate support for applying etching fluid, water and ink to the plates on said endless belt of said plate support upon movement past the respective units, said belt of said blanket support being disposed adjacent to said belt of said plate support for receiving an image from the successive plates carried by said belt of the plate support, and impression means adjacent to said belt of said blanket support for transferring an image to a paper sheet at said impression means.

2. Offset printing equipment of claim 1, in which the inking unit includes ink rollers and a tank for containing a liquid that prevents drying, and means supporting said tank for movement in the direction of the ink rollers so that said ink rollers are dipped into the liquid when not in use.

3. In offset printing equipment as defined in claim 1, said belt of said plate support and said belt of said blanket support being positioned with runs of said belts affording a clearance in which said etching unit is disposed.

4. In offset printing equipment as defined in claim 1, said plate support being disposed above said blanket support, said plate feeding means being disposed vertically above said belt of said plate support for supplying successive plates to an upper run, sheet feeding means below the lower run of said belt of said blanket support to supply successive sheet to said impression means.

5. In offset printing equipment as defined in claim 1, said belt of said plate support and said belt of said blanket support defining a horizontally diverging space there between, said etching unit, said dampening unit being disposed in said diverging space.

6. In offset printing equipment as defined in claim 5, including a cleaning unit and a drying unit associated with the belt of said blanket support, said etching unit said dampening unit, said inking unit, said cleaning unit and said drying unit being incorporated in a cassette structure removably disposed in said diverging space in cooperative relation to said belts of said plate support and said blanket support.

* * * * *